US007893339B2

(12) United States Patent
Hasebe

(10) Patent No.: US 7,893,339 B2
(45) Date of Patent: Feb. 22, 2011

(54) AUDIO REPRODUCTION APPARATUS AND METHOD AND STORAGE MEDIUM

(75) Inventor: Kiyoshi Hasebe, Hamamatsu (JP)

(73) Assignee: Yamaha Corporation (JP)

( * ) Notice: Subject to any disclaimer, the term of this patent is extended or adjusted under 35 U.S.C. 154(b) by 619 days.

(21) Appl. No.: 11/850,236

(22) Filed: Sep. 5, 2007

(65) Prior Publication Data

US 2008/0060502 A1 Mar. 13, 2008

(30) Foreign Application Priority Data

Sep. 7, 2006 (JP) ..... 2006-242674

(51) Int. Cl.
*A63H 5/00* (2006.01)
*G04B 13/00* (2006.01)

(52) U.S. Cl. ..... 84/609; 84/610; 84/616; 84/649; 84/650; 84/654

(58) Field of Classification Search ..... None
See application file for complete search history.

(56) References Cited

U.S. PATENT DOCUMENTS

| | | | | |
|---|---|---|---|---|
| 6,897,779 | B2 | 5/2005 | Nishitani et al. | |
| 6,933,434 | B2 * | 8/2005 | Nishitani et al. | 84/615 |
| 7,080,016 | B2 * | 7/2006 | Miyashita et al. | 704/278 |
| 2002/0166439 | A1 * | 11/2002 | Nishitani et al. | 84/600 |
| 2003/0066413 | A1 * | 4/2003 | Nishitani et al. | 84/615 |
| 2003/0167908 | A1 * | 9/2003 | Nishitani et al. | 84/723 |
| 2004/0089133 | A1 * | 5/2004 | Georges | 84/609 |
| 2004/0255759 | A1 * | 12/2004 | Gayama | 84/613 |
| 2006/0185501 | A1 | 8/2006 | Shiraishi et al. | |
| 2008/0060502 | A1 * | 3/2008 | Hasebe | 84/609 |
| 2008/0276793 | A1 * | 11/2008 | Yamashita et al. | 84/611 |

FOREIGN PATENT DOCUMENTS

| | | |
|---|---|---|
| JP | 2001-170352 A | 6/2001 |
| JP | 2001-232058 A | 8/2001 |
| JP | 2002-251186 A | 9/2002 |

(Continued)

OTHER PUBLICATIONS

Office Action, dated Jul. 29, 2008, issued in corresponding JP application No. 2006-242674. English translation provided.

(Continued)

*Primary Examiner*—Marlon T Fletcher
(74) *Attorney, Agent, or Firm*—Rossi, Kimms & McDowell LLP

(57) ABSTRACT

Audio reproduction apparatus and method for controlling audio data reproduction in accordance with a user operation or input extracts a predetermined musical characteristic, such as a rhythm, melody, etc., from audio data and generates a time information string indicating reproduction timings. During the audio data reproduction, a user operation/input on the apparatus based on a sensor output can be detected to generate detection information indicating a user operation/input timing, and determine whether or not the user operation/input timing coincides with a corresponding one of the reproduction timings indicated by the time information string. A sound system can reproduce the audio data as is, if both timings coincide with each other. Otherwise, predetermined effects can be added to the audio data or the audio data can be manipulated during reproduction.

19 Claims, 5 Drawing Sheets

FOREIGN PATENT DOCUMENTS

| | | | |
|---|---|---|---|
| JP | 2003-091281 | A | 3/2003 |
| JP | 2004-302053 | A | 10/2004 |
| JP | 2006-091631 | A | 4/2006 |

OTHER PUBLICATIONS

Notification of Reasons for Rejection issued in corresponding Japanese Patent Application No. 2008-333936 which is a divisional application of Japanese Patent Application No. 2006-242674, dated Mar. 16, 2010. (English Translation provided).

Notification of Reasons for Rejection issued in corresponding Japanese Patent Application No. 2008-333936 which is a divisional application of Japanese Patent Application No. 2006-242674, dated Jul. 13, 2010. (English Translation provided).

* cited by examiner

AUDIO REPRODUCTION APPARATUS AND METHOD AND STORAGE MEDIUM

BACKGROUND

Conventionally, there has been known a music reproduction apparatus with game feature, which detects a user operation directed to an image moving on a display screen in time with the reproduction of music, evaluates the suitability (accuracy) of timing of the user operation, and based on a result of the evaluation, generates an effect sound or controls a displayed content on the screen. See, for example, Japanese Laid-open Patent Publication No. 2001-232058.

The above music reproduction apparatus (game machine) is stored beforehand with an event data string synchronous with music, and displays an image on a display screen according to the event data, while reproducing the music. When a user performs an operation directed to the image moving according to the event data, a difference between a moving position of the image and a user operation position on the screen is detected, and the suitability (accuracy) of user operation timing is evaluated.

To perform predetermined control such as sounding control or screen display control in accordance with the determined suitability of the user operation timing, it is necessary to carry out beforehand an authoring process to prepare an event data string synchronous with music, which poses a problem.

SUMMARY OF THE INVENTION

The present invention relates to audio reproduction apparatus and method, and a storage medium, and more particularly, to audio reproduction apparatus and method for controlling reproduction of audio data in accordance with whether a user operation/input is performed in time with the reproduction of audio data, and a storage medium storing a program for controlling the audio reproduction apparatus.

One aspect of the present invention is an audio reproduction apparatus. The apparatus can include a storage unit, a reproducing unit, an operation unit, a characteristic extracting unit, a comparison unit, and a control unit. The storage unit can store audio data. The reproduction unit can reproduce the audio data. The operation unit can detect an input and generate detection information along a time axis. The characteristic extraction unit can extract a predetermined musical characteristic from the audio data along a reproduction time axis, and generate a time information string indicating reproduction timings of the predetermined musical characteristic along the reproduction time axis. The comparison unit can compare the detection information and the time information string. The control unit can manipulate the audio data during reproduction of the audio data based on a result of comparison performed by the comparison unit.

The apparatus can further include a musical tone generator unit that can generate musical tone data in accordance with the detection information generated by the operation unit. The characteristic extraction unit can extract a particular frequency band or a particular musical instrument sound from the audio data, and generate, as the time information string, a particular time information string indicating timings at which a musical tone corresponding to the particular frequency band or the particular musical instrument sound are to be sounded. The characteristic extraction unit can erase particular audio data parts of the audio data corresponding to the particular frequency band or the particular musical instrument sound after extracting the particular frequency band or the particular musical instrument sound from the audio data. The characteristic extraction unit can increase, by a predetermined value, a time width of each of pieces of time information forming the time information string.

The control unit can supply the reproduction unit with the audio data from which the particular audio data parts have been erased and mixed with the musical tone data generated by the musical tone generator unit. The control unit can manipulate the audio data from which the particular audio data parts have been erased based on the result of comparison by the comparison unit. The control unit can change the manner of the reproduction of the audio data based on the result of the comparison by the comparison unit during the reproduction of the audio data. In this respect, the control unit can temporarily stop the reproduction of the audio data, control a sound volume, or add an effect to the audio data based on the result of the comparison by the comparison unit during the reproduction of the audio data.

The apparatus can further include a display unit. The control unit can change the display on the display unit based on the result of the comparison by the comparison unit during the reproduction of the audio data. The operation unit can include at least one operation button operable by a user, an acceleration sensor for detecting acceleration applied thereto, or a magnetic sensor for detecting a change in magnetic field generated as a result of the movement applied thereto (or any combination of thereof). The operation unit can detect user operation when the operation button is operated.

Another aspect of the present invention is an audio reproduction method. The method can include a storage step of storing audio data, a reproduction step of reproducing the audio data, a detection step of detecting an input and generating detection information along a time axis, a characteristic extraction step of extracting a predetermined musical characteristic from the audio data along a reproduction time axis and generating a time information string indicating reproduction timings of the predetermined musical characteristic along the reproduction time axis, a comparison step of comparing the detection information and the time information string, and a control step of manipulating the audio data during reproduction of the audio data based on a result of comparison performed in the comparison step.

The method can further include a musical tone generation step of generating musical tone data with a musical tone generator unit in accordance with the detection information generated in the detection step. The characteristic extraction step can extract a particular frequency band or a particular musical instrument sound from the audio data, and generate, as the time information string, a particular time information string indicating timings at which a musical tone corresponding to the particular frequency band or the particular musical instrument sound are to be sounded. The method can further include an erasing step of erasing particular audio data parts of the audio data corresponding to the particular frequency band or the particular musical instrument sound after extracting the particular frequency band or the particular musical instrument sound from the audio data.

The control step can supply for the reproduction step, the audio data with the audio data from which the particular audio data parts have been erased and mixed with the musical tone data generated by the musical tone generator unit. The control step can manipulate the audio data from which the particular audio data parts have been erased based on the result of comparison made in the comparison step.

Another aspect of the present invention is a computer-readable storage medium storing a computer program for controlling the audio reproduction apparatus. The computer program can include the instructions for storing audio data, reproducing the audio data, detecting an input and generating detection information along a time axis, extracting a predetermined musical characteristic from the audio data along a reproduction time axis, and generating a time information string indicating reproduction timings of the predetermined musical characteristic along the reproduction time axis, comparing the detection information and the time information string, and manipulating the audio data during reproduction of the audio data based on a result of the comparison between the detecting information and the time information string.

The program can further include the instruction for generating musical tone data with a musical tone generator unit in accordance with the detection information. The characteristic extraction instruction can extract a particular frequency band or a particular musical instrument sound from the audio data, and generate, as the time information string, a particular time information string indicating timings at which a musical tone corresponding to the particular frequency band or the particular musical instrument sound are to be sounded. The program can further include the instruction for erasing particular audio data parts of the audio data corresponding to the particular frequency band or the particular musical instrument sound after extracting the particular frequency band or the particular musical instrument sound from the audio data.

The manipulation instruction can supply, for the reproduction instruction, the audio data from which the particular audio data parts have been erased and mixed with the musical tone data generated by the musical tone generator unit. The manipulation instruction can manipulate the audio data from which the particular audio data parts have been erased based on the result of comparison made in the comparison instruction.

Further features of the present invention will become apparent from the following description of exemplary embodiments with reference to the attached drawings.

DETAILED DESCRIPTION

The present invention will now be described in detail below with reference to the drawings showing preferred embodiments thereof.

Figure 1:
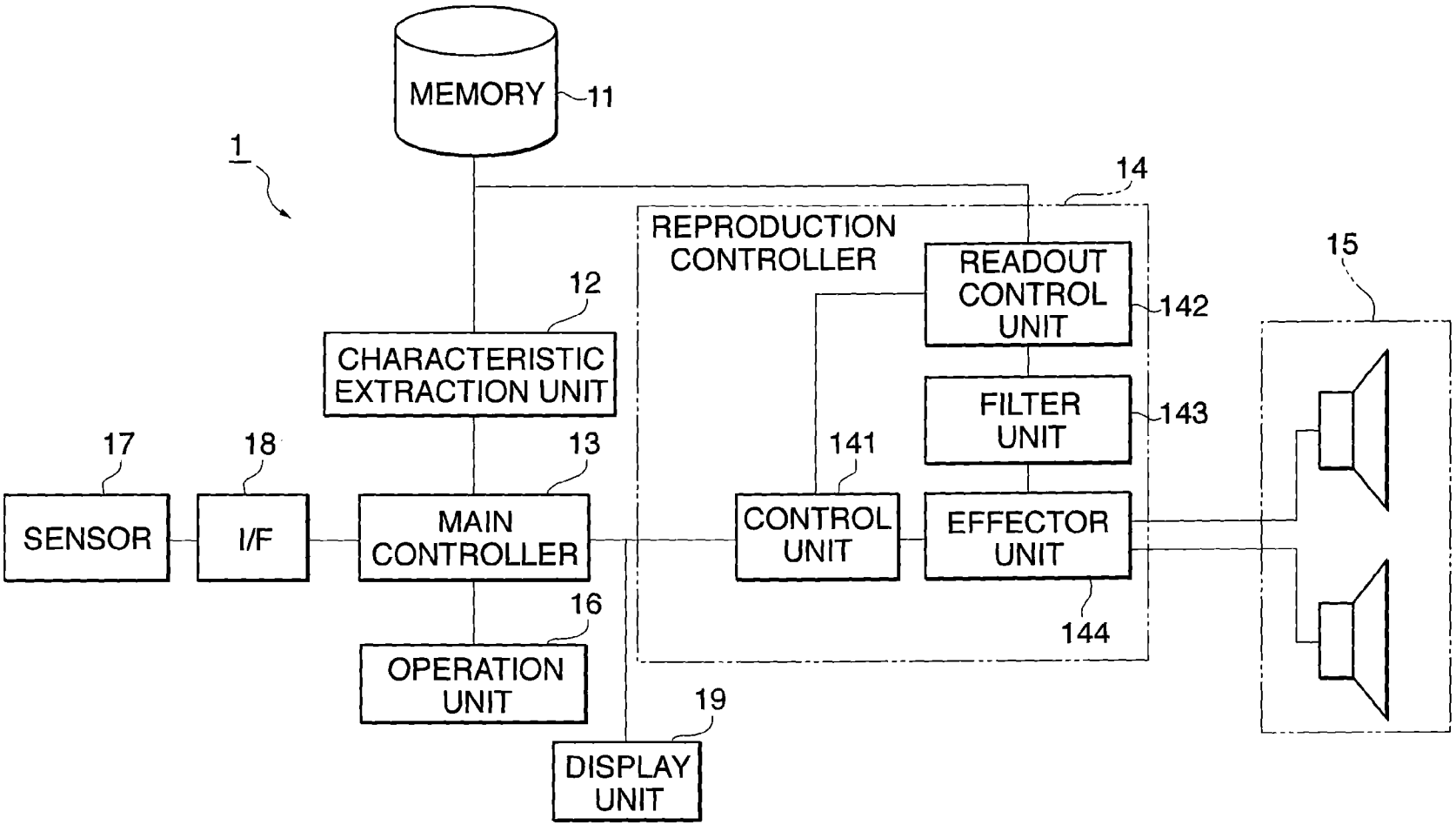
FIG. 1 is a structural view showing the construction of a first embodiment of an audio reproduction apparatus according to the present invention.

FIG. 1 is a structural view showing the construction of a first embodiment of an audio reproduction apparatus 1 according to the present invention. The audio reproduction apparatus 1 of this embodiment is designed to be held by a user with hand so as to permit the user to manipulate the apparatus 1, such as shaking the entire audio reproduction apparatus 1. The audio reproduction apparatus 1 can include a memory or storage 11 for storing audio data. The audio data can be compressed using a predetermined compression technique, such as MPEG, AAC, or the like. A characteristic extraction unit 12 extracts a musical character (rhythm, melody, or the like) of the audio data along a reproduction time axis from the audio data stored in the memory 11, and outputs a time information string indicative of reproduction timings of the musical characteristic. A display unit 19 can be included for displaying purposes. The detail of operation of the characteristic extraction unit 12 will be described later with reference to FIGS. 2 and 3.

A main controller or comparison unit 13 inputs data indicating a reproduction timing of the musical characteristic from the characteristic extraction unit 12, and inputs data indicating a user input timing from a first operation unit 17, which can be a sensor, via an interface 18. Based on these data, the main controller 13 determines the suitability (accuracy) of timing of the user based operation, and outputs data representing a result of the determination to a reproduction controller 14. Furthermore, the main controller 13 can control the reproduction controller 14 based on a user instruction input from a second operation unit 16.

The reproduction controller 14 reads out music data stored in the memory 11, controls a reproduction condition based on the result of the determination input from the main controller 13, and causes a sound system or reproduction unit 15 to implement audio data reproduction in the reproduction condition that is made different depending on whether or not the user input timing is suitable. The reproduction controller 14 includes a control unit 141 for outputting an instruction on the reproduction condition to various parts of the reproduction controller 14 based on the determination result input from the main controller 13.

A readout control unit 142 reads out audio data stored in the memory 11 in accordance with the instruction from the control unit 141, and outputs the audio data to a filter unit 143. If the audio data has been compressed, a data extension process is implemented by the readout control unit 142.

In accordance with an instruction input from the control unit 141, the filter unit or erasing unit 143 filters the audio data, such as for cutting a predetermined frequency component of the audio data, and outputs the filtered audio data to an effector unit 144. In accordance with an instruction input from the control unit 141, the effector unit 144 adds an effect to the audio data. The effect can include volume control, low-pass/high-pass filtering, distortion, chorus, reverb, echo, etc.

The sound system 15 can reproduce the audio data output from the effector unit 144. The second operation unit 16 can be provided with a plurality of push buttons or actuators through which the user can input a user instruction. The second operation unit 16 can detect depression of any of the push buttons, and output a result of the detection (the user instruction) to the main controller 13.

The first operation unit 17 can be an acceleration sensor for detecting a motion of the audio reproduction apparatus 1 (for instance, at least a vertical motion input by the user) and for outputting a detection output. The interface 18 inputs the detection output of the sensor 17, and outputs the same to the main controller 13.

Figure 2:
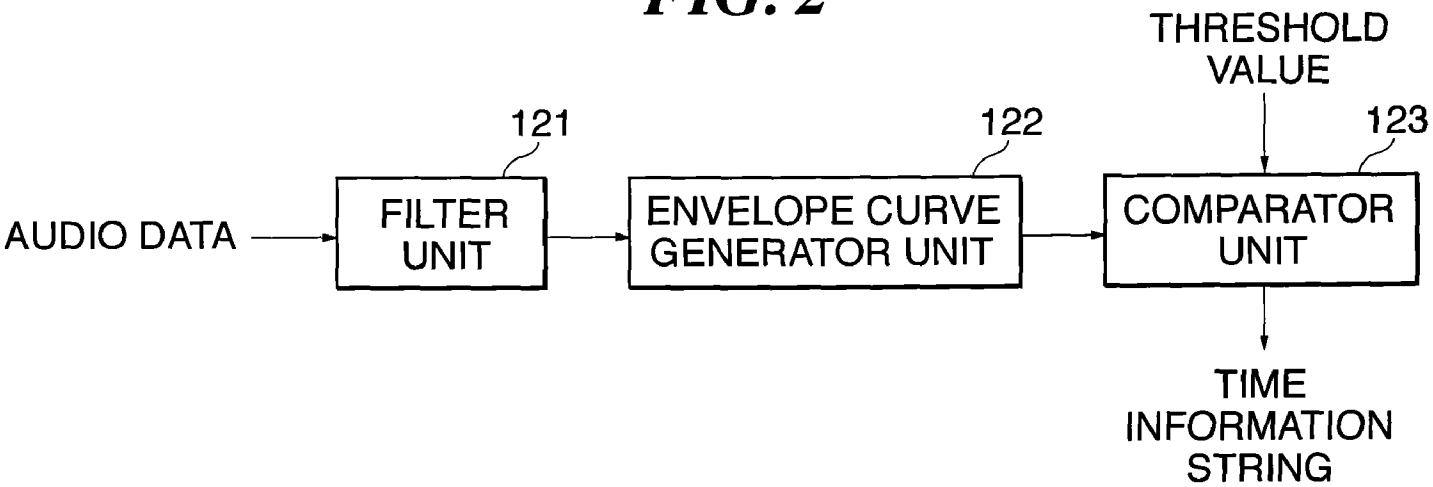
FIG. 2 is a view showing the detail of the construction of a characteristic extraction unit of FIG. 1.

Next, with reference to FIGS. 2 and 3, the detail of operation of the characteristic extraction unit 12 shown in FIG. 1 will be described. FIG. 2 shows the functional construction of the characteristic extraction unit 12. In FIG. 2, the filter unit 121 inputs audio data from the memory 11, and filters (i.e., performs filtering processing) the input audio data to extract a predetermined frequency band of the audio data. For the filtering processing, a cutoff frequency is adjusted to extract bass sounds or bass drum sounds, for instance. It should be noted that the filter unit 121 can be designed to enable the user to select a frequency band to be filtered or a musical instrument sound to be extracted.

An envelope curve generator unit 122 detects crests and troughs of a waveform obtained from the audio data having been subjected to the filtering processing in the filter unit 121, and generates an envelope curve by connecting the waveform crests together and the waveform troughs together. It should be noted that it is not necessary to generate the envelope curve. However, as a result of the envelope curve generation, the waveform can be simplified, resulting in simplified subsequent processing.

The comparator unit 123 inputs waveform data corresponding to the envelope curve from the envelope curve generation unit 122, compares the level of the input waveform data with a predetermined threshold value, and determines a time period along reproduction time axis during which the threshold value is exceeded by the waveform data level. The threshold value is set so that it exceeds at the instance when a bass guitar or a bass drum is played for instance.

The threshold comparator unit 123 outputs a time information string consisting of pieces of time information each of which is at a low level during when the waveform data representing the envelope curve is at a level lower than the threshold value and at a high level during when the waveform data is at a level higher than the threshold value. In this embodiment, the time information string indicating whether or not the predetermined threshold value is exceeded is generated from the waveform data extracted in the filter unit 121 as described above, whereby the rhythm of audio data can be detected.

Figure 3A:
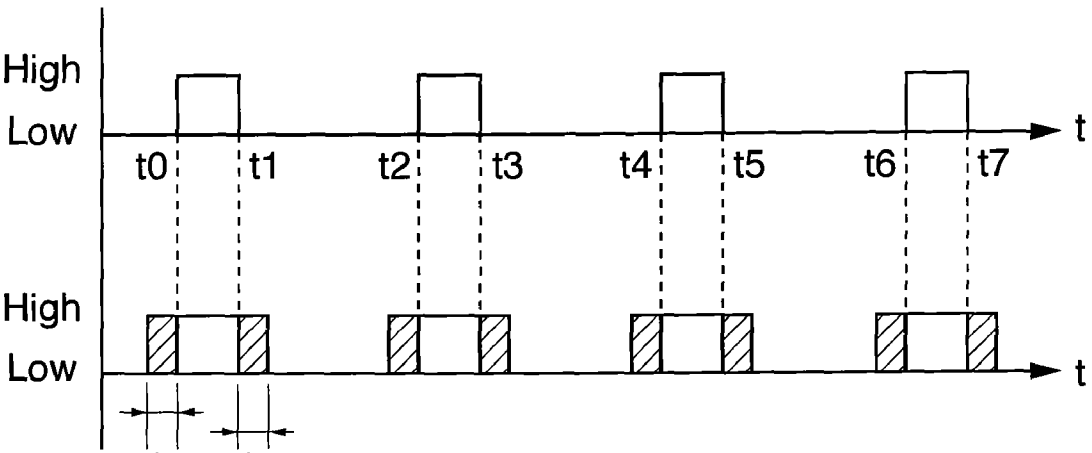
FIG. 3A is a view showing an example of a time information string output from a comparator unit shown in FIG. 1.

FIG. 3A shows an example of the time information string output from the comparator unit 123. In this example, waveform data representing the envelope curve is at a level exceeding the threshold value during time periods from t0 to t1, from t2 to t3, from t4 to t5, and from t6 to t7, along the reproduction time axis of audio data.

Figure 3B:
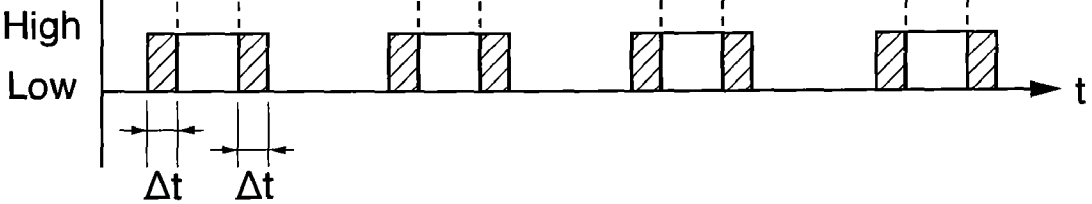
FIG. 3B is a view showing another example of the time information.

FIG. 3B shows another example of the time information string in which a predetermined time width Δt is added to both the leading and trailing edges of each piece of the time information in FIG. 3A. Specifically, in the time information string in FIG. 3B, the waveform data is at a high level in time periods from t0−Δt to t1+Δt, from t2−Δt to t3+Δt, from t4−Δt to t5+Δt, and from t6−Δt to t7+Δt.

By broadening the width of the time information along the reproduction time axis, it is possible for the main controller 13 to determine that a user operation or input is implemented in proper timing, even if the user operation or input timing is somewhat deviated ahead of or behind the proper timing.

It should be noted that when the audio data is comprised of melody of single tones or notes, the melody can be detected by simply comparing the level of a waveform of audio data with a predetermined threshold value to create the time information string indicative of sound reproduction timings, without the need of implementing filtering processing or envelope curve generation processing.

Figure 4:
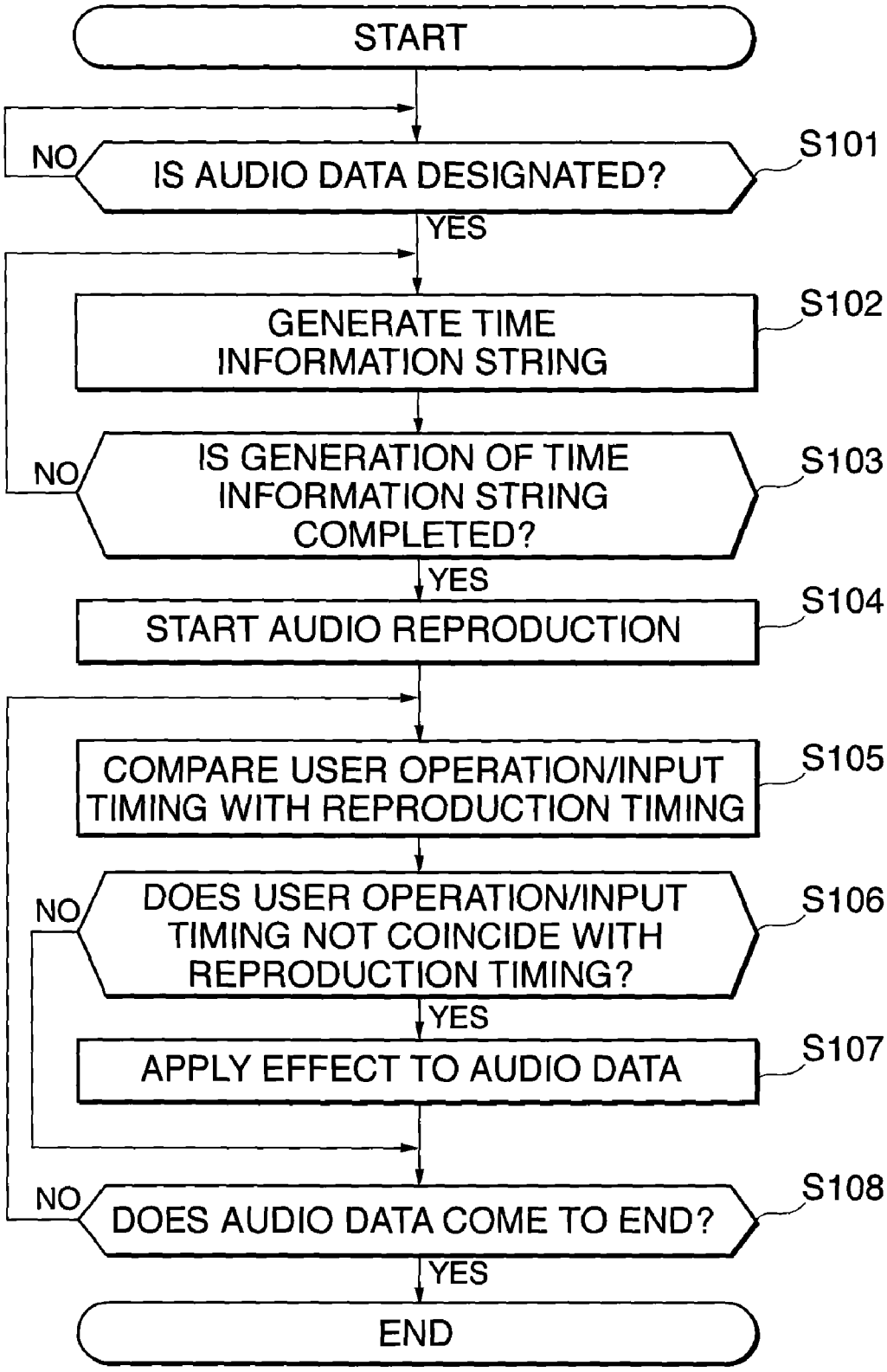
FIG. 4 is a flowchart showing the procedure of detecting a user operation and controlling audio reproduction in the audio reproduction apparatus shown in FIG. 1.

Next, with reference to a flowchart in FIG. 4, the procedure of detecting a user input/operation and controlling audio reproduction will be described, which is implemented by the audio reproduction apparatus in FIG. 1. As shown in FIG. 4, at the start of an audio reproduction process, the main controller 13 determines whether or not audio data to be reproduced is designated by the user by depressing one of the push buttons of the operation unit 16 (step S101).

When it is determined at the step S101 that the designation of audio data to be reproduced is input from the second operation unit 16, the main controller 13 instructs the characteristic extraction unit 12 to generate a time information string for the audio data. In response to this instruction, the characteristic extraction unit 12 reads out the audio data specified by the main controller 13 from the memory 11, and generates a time information string for the audio data (step S102).

It should be noted that if the time information string has once been generated, the generated time information string can be stored in a memory of the audio reproduction apparatus 1, such as the memory 11 or another memory (not shown). In the next reproduction of audio data, the procedure in steps S101 to S103 is omitted, and the already-generated time information string is used in the processing in step S104 and subsequent steps. The generation of the time information string in the step S102 can be performed in real time, while the audio data is being reproduced.

When it is determined that the generation of the time information string by the characteristic extraction unit 12 is completed (Yes to the step S103), the main controller 13 temporarily stores the time information string and gives the reproduction controller 14 an instruction to start audio data reproduction (step S104). When instructed from the main controller 13 to start the audio data reproduction, the control unit 141 of the reproduction controller 14 instructs the read-out control unit 142 to read out from the memory 11 the audio data to be reproduced. At the start of the audio data reproduction, the audio data is reproduced by the sound system 15, without being subjected to the processing in the filter unit 143 and the effector unit 144. When and after the audio data reproduction is started, the main controller 13 inputs an output of the sensor 17 via the interface 18. If the user shakes the audio reproduction apparatus in a predetermined manner (for example, if the user vertically shakes the apparatus), the sensor 17 detects an acceleration in a predetermined axis direction (for example, an acceleration in a vertical direction), and outputs acceleration data (sensor output) to the main controller 13.

In this embodiment, the acceleration sensor is employed for detecting user operation/input. Alternatively, a magnetic sensor can be used to detect a change in earth magnetism in a predetermined axis direction when the user shakes the audio reproduction apparatus in a predetermined manner.

Based on the output of the sensor 17, the main controller 13 can generate detection information indicating a time when the detected acceleration exceeds a threshold value (i.e., user operation/input timing). This detection information can be saved in the memory 11 or another memory, such as an external memory device supplied by the user. The detection information can indicate the user operation/input timing. Next, the main controller 13 compares the detection information with time information indicating a reproduction timing (corresponding to a time period elapsed from the start of audio data reproduction) of the musical characteristic of the audio data and contained in the time information string generated from the audio data (step S105), thereby determining whether or not the detection information coincides with the time information (step S106). The main controller 13 outputs a result of this determination to the control unit 141 of the reproduction controller 14.

If it is determined at the step S106 that the detection information (user operation/input timing) coincides with the time information (reproduction timing) (No in the step S106), the control unit 141 causes the sound system 15 to reproduce the audio data, without performing predetermined processing on the audio data. On the other hand, if it is determined at the step S106 that the detection information does not coincide with the time information (Yes in the step S106), the control unit 141 instructs the filter unit 143 and the effector unit 144 to implement the predetermined processing on the audio data (step S107).

In the processing at the step S107, the filter unit 143 can cut a predetermined frequency region of the audio data, and the effector unit 144 can add a predetermined effect to the audio data or reduces the reproduction volume, for example. To implement such processing, it is possible to determine the desired type and intensity of processing and the desired number of processing to which the audio data is simultaneously subjected on the basis of a time difference between the user operation/input timing and the reproduction timing, the number of times of occurrences of non-coincidence between these timings, or the like. Subsequently, the steps S105 to S108 can be repeatedly executed until the audio data reproduction is completed.

It should be noted that in addition to applying effects to the audio data, the step S107 can temporarily terminate the audio data reproduction. The result of the comparison in the step S105 simply can be displayed on the display unit 19 or simply be stored in a memory device in the audio reproduction apparatus 1, with the reproduced sound not altered. In the time information string in FIG. 3, each of pieces of time information is binary data that varies between high and low levels determined using a threshold value. However, the time information can be three or more valued data determined using two or more threshold values. In that case, three or more valued data can be obtained from the output of the sensor 17 using two or more threshold values. Moreover, it is not necessary that the sensor 17 be formed integrally with a main body of the audio reproduction apparatus to enable the sensor 17 to detect acceleration acting on the entire audio reproduction apparatus when the user manipulates the apparatus, such as vertically or horizontally moving the same. For example, the sensor 17 can be formed separately from the main body of the audio reproduction apparatus so that the sensor 17 can detect acceleration acting on the sensor 17 only when the user moves the sensor 17.

The audio reproduction apparatus according to this embodiment is configured such that the characteristic extraction unit 12 can generate, from the audio data, the time information string that includes pieces of time information each indicating a reproduction timing of the musical characteristic of the audio data, which eliminates the necessity of performing authoring process on the audio data in advance to prepare event data string synchronous with the audio data.

In the present embodiment, if the reproduction timing of the musical characteristic of the audio data indicated by each piece of time information in the time information string generated from audio data does not coincide with the timing of a corresponding user operation/input, the manner of audio data reproduction can be altered by temporarily terminating the audio data reproduction, by applying effects to the audio data, or the like. For this reason, to obtain the desired audio reproduction, the user is required to manipulate (for example, vertically shake) the audio reproduction apparatus 1 in proper timing with the audio data reproduction. As a result, the user can have an actual feeling of participating in music reproduction through the medium of operating the audio reproduction apparatus of this embodiment, rather than simply listening to the reproduced music.

Figure 5:
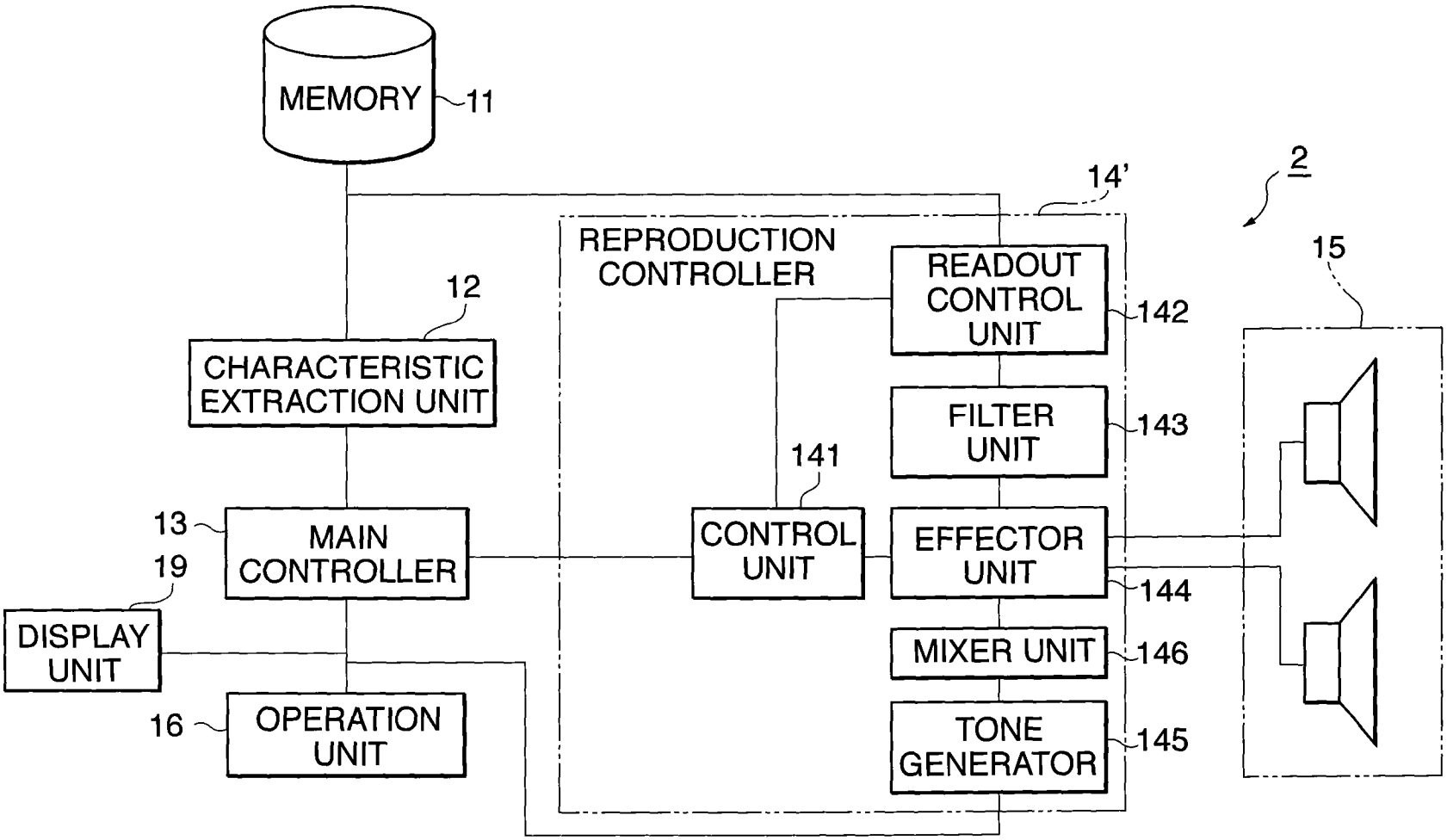
FIG. 5 is a structural view showing the construction of a second embodiment of an audio reproduction apparatus according to the present invention.
Figure 6:
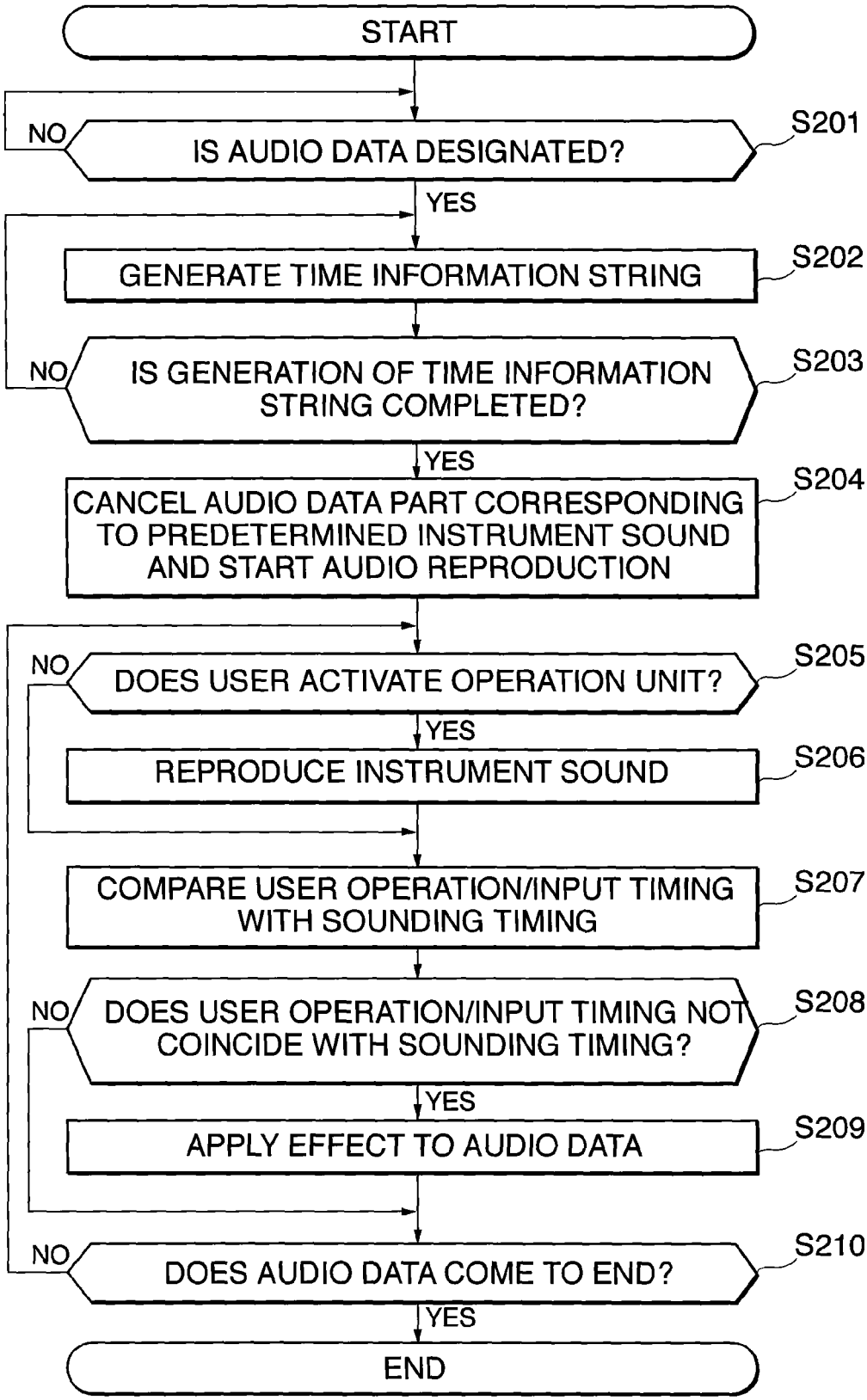
FIG. 6 is a flowchart showing the procedure of detecting user operation and controlling audio reproduction in the audio reproduction apparatus shown in FIG. 5.

Next, with reference to FIGS. 5 and 6, a second embodiment of the present invention will be described below. FIG. 5 shows a structural view showing the construction of an audio reproduction apparatus 2 according to the second embodiment. In FIG. 5, like elements similar to those shown in FIG. 1 are denoted by like reference numerals, with the explanation thereof omitted.

The reproduction controller 14' of the audio reproduction apparatus 2 includes a musical tone generator unit 145 that includes stored pieces of tone color data representative of tone colors of various instruments. If a detection signal generated when one of a plurality of push buttons or actuators of the operation unit 16 is depressed by the user is input from the unit 16, the tone generator 145 can generate musical tone data corresponding to the depressed push button. A mixer unit 146 mixes audio data output from the effector unit 144 with musical tone data output from the tone generator 145, and outputs the mixed data to the sound system 15.

In the second embodiment, the characteristic extraction unit 12 detects from the audio data the rhythm of predetermined musical instrument sound, and the tone generator 145 outputs musical tone data for the predetermined musical instrument sound in time with the depression of push buttons of the operation unit 16 (user operation/input timing) to the sound system 15, which reproduces corresponding musical tones. In the reproduction controller 14', the readout control unit 142 reads out the audio data and outputs the same to the filter unit 143 under the control of the control unit 141, and the filter unit 143 cancels or deletes particular parts of the audio data corresponding to the predetermined instrument sound from the audio data, so that the audio data, from which the audio data parts corresponding to the predetermined instrument sound have been canceled, can be reproduced by the sound system 15.

It should be noted that the filter unit 143 can be designed, not only to cancel or remove audio data part corresponding to a particular musical instrument sound, but to cancel or remove audio data part corresponding to a particular frequency band component. For example, if an LPF (low pass filter) with cutoff frequency Hc is employed in the filter unit 121 of the characteristic extraction unit 12, then an HPF (high pass filter) with cutoff frequency Hc is employed in the filter unit 143 of the reproduction controller 14'.

Next, with reference to a flowchart shown in FIG. 6, an explanation will be given of the procedure of detecting a user operation/input and controlling audio reproduction, which is implemented by the audio reproduction apparatus in FIG. 5. Referring to FIG. 6, when an audio reproduction process is started, the main controller 13 determines whether or not the designation of audio data to be reproduced is input from the operation unit 16 (step S201).

When it is determined at the step S201 that the designation of audio data to be reproduced is input from the operation unit 16, the main controller 13 instructs the characteristic extraction unit 12 to generate a time information string for the audio data. The characteristic extraction unit 12 reads out the audio data specified by the main controller 13 from the memory 11, and generates a time information string for the audio data (step S202). In the second embodiment, the time information string indicates timings at which musical tone data generated in the tone generator 145 are to be sounded by the sound system 15.

It should be noted that if the time information string has once been generated, the generated time information string can be stored in a memory in the audio reproduction apparatus 2. At the next reproduction of audio data, the procedure in steps S201 to S203 is omitted, and the already-generated time information string is used in the processing in step S204 and subsequent steps.

When it is determined that the generation of the time information string by the characteristic extraction unit 12 is completed (Yes to step S203), the main controller 13 temporarily stores the time information string and gives the reproduction controller 14' an instruction to cancel a predetermined musical instrument sound and then start the reproduction of the audio data (step S204). The predetermined musical instrument sound is a musical instrument sound with which the user performs push-button-based musical performance and which is reproduced in a step S206 described later.

When inputting the instruction to start the audio data reproduction from the main controller 13, the control unit 141 in the reproduction controller 14' instructs the readout control unit 142 to read out from the memory 11 the audio data to be reproduced. The filter unit 143 performs filtering processing on the audio data read out by the readout control unit 142 so as to cancel audio data part corresponding to the predetermined musical instrument sound, and then outputs the audio data with the predetermined instrument sound part having been canceled to the effector unit 144.

When the audio data reproduction is started, the main controller 13 can input data indicating a user activating the operation unit 16 (step S205). If the user has depressed one of the push buttons of the operation unit 16 (Yes to step 205), the operation unit 16 detects the push button being depressed and outputs data indicating the push button depression to the main controller 13 and the tone generator 145.

In accordance with the data output from the operation unit 16, the tone generator 145 generates musical tone data for the predetermined musical instrument sound and outputs the same to the mixer unit 146. The mixer unit 146 mixes the audio data input from the effector unit 144 and the musical tone data input from the tone generator 145, and causes the sound system 15 to perform audio reproduction based on the mixed data (step S206).

Based on a result of the detection by the operation unit 16, the main controller 13 generates detection information indicating a time point at which the push button of the operation unit 16 has been depressed (i.e., a user operation/input timing). Next, the main controller 13 compares the detection information generated based on the result of determination by the operation unit 16 with time information indicating a sounding timing (corresponding to a time period elapsed from the start of audio reproduction) of the predetermined instrument sound and contained in the time information string generated from the audio data (step S207), thereby determining whether or not the detection information coincides with the time information (step S208). The main controller 13 outputs a result of this determination to the control unit 141 of the reproduction controller 14'.

If it is determined at the step S208 the detection information (user operation/input timing) coincides with the time information (sounding timing) (No in the step S208), the control unit 141 causes the sound system 15 to reproduce the audio data, without the audio data being subjected to processing other than the musical instrument sound cancellation. On the other hand, if it is determined at the step S208 that the detection information does not coincide with the time information (Yes in the step S208), the control unit 141 instructs the filter unit 143 and the effector unit 144 to implement predetermined processing on the audio data (step S209).

In the processing in the step S209, the filter unit 143 cuts a predetermined frequency region of the audio data, or the effector unit 144 adds predetermined effect or reduces the reproduction volume, for example. In a step S210, whether or not the audio data has reached its end is determined. Subsequently, the steps S205 to S210 are repeatedly carried out until completion of the audio data reproduction.

It should be noted that the audio reproduction can be temporarily stopped in the step S209 in addition to adding effects to the audio data. Furthermore, the reproduced sound need not be altered. In that case, the degree of coincidence in the comparison between user operation/input timing and sounding timing at the step S207 simply can be displayed in a display unit (not shown) or simply can be stored in a memory of the audio reproduction apparatus 2. A mixture of the original audio data and musical tone data generated by the tone generator 145 can be reproduced, without the musical instrument sound being canceled in the step S204. It is not necessary to use push buttons for user operation. Alternatively, a MIDI instrument, which is connected to the audio reproduction apparatus 2, can be used so that detection information generated based on performance (user operation) of the MIDI instrument can be sent to the main controller 13.

As described above, with the audio reproduction apparatus of this embodiment, the user is enabled to perform performance of a particular musical instrument by depressing one or more push buttons of the operation unit 16. Therefore, the user can participate in the audio data reproduction by depressing the push button in time with the rhythm of the musical instrument.

It is to be understood that the present invention can also be accomplished by supplying a system or an apparatus with a storage medium in which a program code of software, which realizes the functions of the above described embodiments is stored, and causing a computer (or CPU or MPU) of the system or apparatus to read out and execute the program code stored in the storage medium. In this case, the program code itself read from the storage medium can realize the functions of the above described embodiments, and therefore the program code/the storage medium in which the program code is stored constitute other aspects of the present invention. Examples of the storage medium for supplying the program code include a floppy (registered trademark) disk, a hard disk, a magnetic-optical disk, an optical disk such as a CD-ROM, a CD-R, a CD-RW, a DVD-ROM, a DVD-RAM, a DVD-RW, a DVD+RW, a magnetic tape, a nonvolatile memory card, and a ROM.

Further, it is to be understood that the functions of the above described embodiments can be accomplished not only by executing the program code read out by a computer, but also by causing an OS (operating system) or the like that operates on the computer to perform a part or all of the actual operations based on instructions of the program code.

Further, it is to be understood that the functions of the above described embodiments can be accomplished by writing a program code read out from the storage medium into a memory provided on an expansion board inserted into a computer or a memory provided in an expansion unit connected to the computer and then causing a CPU or the like provided in the expansion board or the expansion unit to perform a part or all of the actual operations based on instructions of the program code.

The present embodiments thus can be suitable for use in an audio reproduction apparatus for detecting whether a user operation is performed in time with the reproduction of audio data. The control unit can supply the reproduction unit with the audio data from which the particular audio data part has been erased and mixed with the musical tone data generated by the musical tone generator unit. The control unit can perform the predetermined control on the audio data from which the particular audio data part has been erased based on the result of comparison by the comparison unit. The characteristic extraction unit can increase a time width of each of pieces of time information forming the time information string by a predetermined value. The control unit can change a manner of the reproduction of the audio data based on the result of the comparison by the comparison unit during the reproduction of the audio data. The control unit can temporarily stop the reproduction of the audio data or can control a sound volume or can add an effect to the audio data based on the result of the comparison by the comparison unit during the reproduction of the audio data. The audio reproduction apparatus can further include a display unit, and the control unit can change a display on the display unit based on the result of the comparison by the comparison unit during the reproduction of the audio data.

According to the present embodiments, a musical characteristic of audio data can be extracted by the characteristic extraction unit or in the characteristic extraction step, and based thereon, can generate a time information string indicating reproduction timings of the musical characteristic, making it possible to control audio data reproduction in accordance with a user operation, without the need of creating in advance event data string synchronous with the audio data.

Furthermore, it is possible to perform control during the audio reproduction, such as changing the manner of audio data reproduction or changing a displayed content on a display unit, based on detection information indicating the manner of a user operation and generated by the detection unit or in the detection step. As a result, it is possible for the user to have an actual feeling of participating in the audio reproduction through the medium of performing the user operation, rather than merely listening to the audio reproduction.

While the present invention has been particularly shown and described with reference to preferred embodiment thereof, it will be understood by those skilled in the art that the foregoing and other changes in form and details can be made therein without departing from the spirit and scope of the present invention. All modifications and equivalents attainable by one versed in the art from the present disclosure within the scope and spirit of the present invention are to be included as further embodiments of the present invention. The scope of the present invention accordingly is to be defined as set forth in the appended claims.

This application is based on, and claims priority to, JP PA 2006-242674, filed on 7 Sep. 2006. The disclosure of the priority application, in its entirety, including the drawings, claims, and the specification thereof, is incorporated herein by reference.

What is claimed is:

1. An audio reproduction apparatus comprising:

a storage unit for storing audio data;

a reproduction unit for reproducing the audio data;

an operation unit for detecting an input and generating detection information along a time axis;

a characteristic extraction unit for extracting a predetermined musical characteristic from the audio data along a reproduction time axis, and generating a time information string indicating reproduction timings of the predetermined musical characteristic along the reproduction time axis;

a comparison unit for comparing the detection information and the time information string; and a control unit for manipulating the audio data during reproduction of the audio data based on a result of comparison performed by the comparison unit.

2. The audio reproduction apparatus according to claim 1, further comprising a musical tone generator unit for generating musical tone data in accordance with the detection information generated by the operation unit, wherein the characteristic extraction unit extracts a particular frequency band or a particular musical instrument sound from the audio data, and generates, as the time information string, a particular time information string indicating timings at which a musical tone corresponding to the particular frequency band or the particular musical instrument sound are to be sounded, and wherein the characteristic extraction unit erases particular audio data parts of the audio data corresponding to the particular frequency band or the particular musical instrument sound after extracting the particular frequency band or the particular musical instrument sound from the audio data.

3. The audio reproduction apparatus according to claim 2, wherein the control unit supplies the reproduction unit with the audio data from which the particular audio data parts have been erased and mixed with the musical tone data generated by the musical tone generator unit.

4. The audio reproduction apparatus according to claim 3, wherein the control unit manipulates the audio data from which the particular audio data parts have been erased based on the result of comparison by the comparison unit.

5. The audio reproduction apparatus according to claim 1, wherein the characteristic extraction unit increases, by a predetermined value, a time width of each of pieces of time information forming the time information string.

6. The audio reproduction apparatus according to claim 1, wherein the control unit changes a manner of the reproduction of the audio data based on the result of the comparison by the comparison unit during the reproduction of the audio data.

7. The audio reproduction apparatus according to claim 6, wherein the control unit temporarily stops the reproduction of the audio data, controls a sound volume, or adds an effect to the audio data based on the result of the comparison by the comparison unit during the reproduction of the audio data.

8. The audio reproduction apparatus according to claim 1, further comprising a display unit, wherein the control unit changes a display on the display unit based on the result of the comparison by the comparison unit during the reproduction of the audio data.

9. The audio reproduction apparatus according to claim 1, wherein the operation unit includes at least one operation button operable by a user, and detects user operation when the operation button is operated.

10. The audio reproduction apparatus according to claim 1, wherein the operation unit includes an acceleration sensor for detecting acceleration applied thereto.

11. The audio reproduction apparatus according to claim 1, wherein the operation unit includes a magnetic sensor for detecting a change in magnetic field generated as a result of the movement applied thereto.

12. An audio reproduction method comprising:

a storage step of storing audio data;

a reproduction step of reproducing the audio data;

a detection step of detecting an input and generating detection information along a time axis;

a characteristic extraction step of extracting a predetermined musical characteristic from the audio data along a reproduction time axis and generating a time information string indicating reproduction timings of the predetermined musical characteristic along the reproduction time axis;

a comparison step of comparing the detection information and the time information string; and a control step of manipulating the audio data during reproduction of the audio data based on a result of comparison performed in the comparison step.

13. The method according to claim 12, further comprising:

a musical tone generation step of generating musical tone data with a musical tone generator unit in accordance with the detection information generated in the detection step, wherein the characteristic extraction step extracts a particular frequency band or a particular musical instrument sound from the audio data, and generates, as the time information string, a particular time information string indicating timings at which a musical tone corresponding to the particular frequency band or the particular musical instrument sound are to be sounded, and an erasing step of erasing particular audio data parts of the audio data corresponding to the particular frequency band or the particular musical instrument sound after extracting the particular frequency band or the particular musical instrument sound from the audio data.

14. The method according to claim 13, wherein the control step supplies the reproduction step with the audio data from which the particular audio data parts have been erased and mixed with the musical tone data generated by the musical tone generator unit.

15. The method according to claim 13, wherein the control step manipulates the audio data from which the particular audio data parts have been erased based on the result of comparison made in the comparison step.

16. A computer-readable storage medium storing a computer program for controlling an audio reproduction apparatus, the computer program comprising instructions for:

storing audio data;

reproducing the audio data;

detecting an input and generating detection information along a time axis;

extracting a predetermined musical characteristic from the audio data along a reproduction time axis, and generating a time information string indicating reproduction timings of the predetermined musical characteristic along the reproduction time axis;

comparing the detection information and the time information string; and manipulating the audio data during reproduction of the audio data based on a result of the comparison between the detecting information and the time information string.

17. The computer-readable storage medium according to claim 16, wherein the computer program further includes instructions for:

generating musical tone data with a musical tone generator unit in accordance with the detection information, wherein the characteristic extraction instruction extracts a particular frequency band or a particular musical instrument sound from the audio data, and generates, as the time information string, a particular time information string indicating timings at which a musical tone corresponding to the particular frequency band or the particular musical instrument sound are to be sounded; and erasing particular audio data parts of the audio data corresponding to the particular frequency band or the particular musical instrument sound after extracting the particular frequency band or the particular musical instrument sound from the audio data.

18. The computer-readable storage medium according to claim 17, wherein the manipulation instruction supplies the reproduction instruction with the audio data from which the particular audio data parts have been erased and mixed with the musical tone data generated by the musical tone generator unit.

19. The computer-readable storage medium according to claim 17, wherein the manipulation instruction manipulates the audio data from which the particular audio data parts have been erased based on the result of comparison made in the comparison instruction.

* * * * *